US007194230B2

(12) United States Patent
Haruyama

(10) Patent No.: US 7,194,230 B2
(45) Date of Patent: Mar. 20, 2007

(54) DEVELOPER DISCHARGING UNIT, DEVELOPER RECEIVING UNIT, DEVELOPER TRANSPORTING SYSTEM, AND IMAGE FORMING APPARATUS

(75) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 164 days.

(21) Appl. No.: 11/097,134

(22) Filed: Apr. 4, 2005

(65) Prior Publication Data

US 2005/0226658 A1 Oct. 13, 2005

(30) Foreign Application Priority Data

Apr. 9, 2004 (JP) ..... 2004-116141

(51) Int. Cl.
*G03G 15/08* (2006.01)

(52) U.S. Cl. ..... 399/258; 222/DIG. 1; 399/106; 399/111; 399/119; 399/120; 399/262

(58) Field of Classification Search ..... 399/106, 399/111, 119, 120, 260, 258, 262; 222/DIG. 1
See application file for complete search history.

(56) References Cited

U.S. PATENT DOCUMENTS 5,621,507 A * 4/1997 Nishimura et al. ..... 399/111
6,266,511 B1 7/2001 Murakami et al.
6,438,345 B1 * 8/2002 Ban et al. ..... 399/262
6,968,147 B2 * 11/2005 Matsuda et al. ..... 399/258

FOREIGN PATENT DOCUMENTS

JP 10-123866 5/1998
JP 2000-284660 10/2000
JP 2004-085894 3/2004

* cited by examiner

*Primary Examiner*—Hoang Ngo
(74) *Attorney, Agent, or Firm*—Rabin & Berdo, PC

(57) ABSTRACT

A developer receiving unit receives developer from a discharging unit. The developer receiving unit includes a path through which the developer is received from the developer discharging unit, the path adapted to expand and contract in length. The developer-receiving unit moves into sealed engagement with the developer-discharging unit so that the developer-receiving unit communicates with the developer-discharging unit through the path. An urging member urges the path in such a direction as to expand in length. An opening-and-closing member receives a drive force from the developer-discharging unit when the developer-discharging unit pushes the developer receiving unit, the drive force acting on the opening-and-closing member in such a way that the opening-and-closing member causes the path to open. The opening-and-closing member opens the path only after the developer discharging unit moves into sealed engagement with the developer receiving unit.

10 Claims, 15 Drawing Sheets

DEVELOPER DISCHARGING UNIT, DEVELOPER RECEIVING UNIT, DEVELOPER TRANSPORTING SYSTEM, AND IMAGE FORMING APPARATUS

BACKGROUND OF THE INVENTION

1. Field of the Invention

The present invention relates to a developer-discharging unit, a developer-receiving unit, developer transporting system, and an image forming apparatus.

2. Description of the Related Art

A conventional image-forming apparatus such as a printer, a copying machine, and a facsimile machine uses developer such a stoner. Toner is supplied from a toner cartridge to a developing unit. Then, the developing unit supplies the toner to electrostatic latent images to develop the electrostatic latent images into visible images. Some toner fails to be transferred onto a print medium and remains on a photoconductive drum after transfer of toner images onto a recording medium. A cleaning unit removes the residual toner from the photoconductive drum and feeds the residual toner as waste toner to a toner-transporting path. Then, the waste toner is delivered through the toner-transporting path to a waste toner-receiving unit. In this manner, the toner is delivered from one section to another through various sections in the image forming apparatus.

FIG. 23 illustrates a conventional interface between one section and another section. FIG. 24 illustrates two sections in FIG. 23 coupled together. FIG. 25 is a perspective view of the structure FIG. 24.

Referring to FIGS. 23–25, toner is transported in a toner-transporting path 41 to a waste toner tank 44. A first shutter 42 is pivotally mounted in a forward end portion of the toner-transporting path 41. A second shutter 43 is mounted to the underside of the forward end portion of the toner-transporting path 41 and can slide back and forth in a direction in of movement of the toner-transporting path 41. A third shutter 45 is pivotally mounted to a waste toner tank 44. A spring 46 is mounted on the underside of the forward end portion of the toner-transporting path 41 and urges the second shutter 43 in a direction shown by arrow A. When the toner-transporting path 41 advances in a direction shown by arrow B to fit into an opening 40 formed in the waste toner tank 44, the toner-transporting path 41 pushes the third shutter 45 out of the way and the second shutter 43 abuts the waste toner tank 44 that serves as a topper. The second shutter 43 is pushed back against the urging force of the spring 46, so that the first shutter 42 rotates about a pin 42*a* to downwardly open the forward end portion of the toner-transporting path 41.

With the aforementioned conventional interface between the toner-transporting path 41 and the waste toner tank 44, the third shutter 45 is operatively associated with the forward and backward movements of the toner-transporting path 41, pivoting about a pin 45*a* to open and close the opening 40. Thus, when the toner-transporting path 41 enters or leaves the waste toner tank 44 through the opening 40, the waste toner in the waste toner tank 44 tends to spill through the opening 40. This chance of toner of spilling exists until the forward end portion of the third shutter 45 has fitted into or left the opening 40 completely.

SUMMARY OF THE INVENTION

The present invention was made in view of the aforementioned problems of the conventional art.

An object of the invention is to provide a developer-ejecting unit, a developer receiving unit, a developer-transporting system, and an image forming apparatus that incorporates the developer-ejecting unit, developer receiving unit, and developer-transporting system.

A developer discharging unit discharges developer into a developer receiving unit. The developer is discharged into the developer receiving unit through an opening formed in the developer discharging unit. An opening-and-closing member is movable relative to the opening to open and close the opening. A first urging member urges the opening-and-closing member in such a direction as to close the opening-and-closing member. An engagement portion receives a drive force from the developer receiving unit when the engagement portion engages the developer receiving unit, the drive force acting on the engagement portion in such a way that the opening-and-closing member causes the opening-and-closing member to open. The engagement portion causes the opening-and-closing member to open the opening only after the developer discharging unit moves into sealed engagement with the developer receiving unit so that the developer discharging unit communicates with the developer receiving unit through the opening.

A developer receiving unit receives developer from a discharging unit. The developer is received from the developer discharging unit through a path. The path is adapted to expand and contract in length. When the developer receiving unit moves into sealed engagement with the developer discharging unit, the path communicates with the developer discharging unit through an opening. An urging member urges the path in such a direction as to expand. An opening-and-closing member receives a drive force from the developer discharging unit when the developer discharging unit pushes the developer receiving unit, the drive force acting on the opening-and-closing member in such a way that the opening-and-closing member causes the path to open. The opening-and-closing member opens the path only after the developer discharging unit moves into sealed engagement with the developer receiving unit so that the developer discharging unit communicates with the developer receiving unit through the path.

The path includes a first path member and a second path member that is slidably movable relative to the first path member. The opening-and-closing member includes an engagement portion. When the first path member moves relative to the second path member against the urging member, the first path member engages the engagement portion to cause the opening-and-closing member to open the path.

The second path member fits over the first path member.

The second path member fits in the first path member.

The second path member has a guide surface and the opening-and-closing member has a guide surface. When the guide surface of the second path member pushes the guide surface of the opening-and-closing member, the opening-and-closing member opens the first path.

The first path member has a cleaning member that rubs a surface of the opening-and-closing member.

The path includes a first path member and a second path member, the second path member communicating with the first path and being resiliently movable relative to the first path in such a way that the path expands and contracts in length. The opening-and-closing member includes an engagement portion that receives a drive force from the second path member when the developer discharging unit pushes the developer receiving unit, the drive force acting on the opening-and-closing member in such a way that the opening-and-closing member opens the path.

A developer transporting system includes a developer discharging unit and a developer receiving unit. The developer discharging unit includes a first opening formed in a developer discharging unit and through which developer is discharged from the developer discharging unit. A first opening-and-closing member is mounted to the developer discharging unit and movable relative to the first opening to open and close the first opening. A first urging member is mounted to the developer discharging unit and urging the first opening-and-closing member in such a direction as to close the first opening. The developer is discharged from the developer discharging unit through a path. The path is able to expand and contract in length. The developer receiving unit includes a second opening that is formed in a developer receiving unit and through which the developer is received into the developer receiving unit. A second urging member is mounted to the developer receiving unit and urging the first path member in such a direction as to expand the path. A second opening-and-closing member is mounted to the developer receiving unit to open and close the path. The second opening-and-closing member closes the path when the path expands. The second opening-and-closing member opens only after the developer discharging unit moves into sealed engagement with the developer receiving unit so that the developer discharging unit communicates with the developer receiving unit through the first opening. An engagement portion is mounted to the developer discharging unit. When the engagement portion pushes the developer receiving unit, the engagement portion receives a drive force from the developer receiving unit. The drive force acts on the engagement portion in such a way that the first opening-and-closing member opens the first path.

An image forming apparatus incorporates the aforementioned developer transporting system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The invention will be described with reference to the accompanying drawings.

{General Configuration of Image Forming Apparatus}

Figure 1:
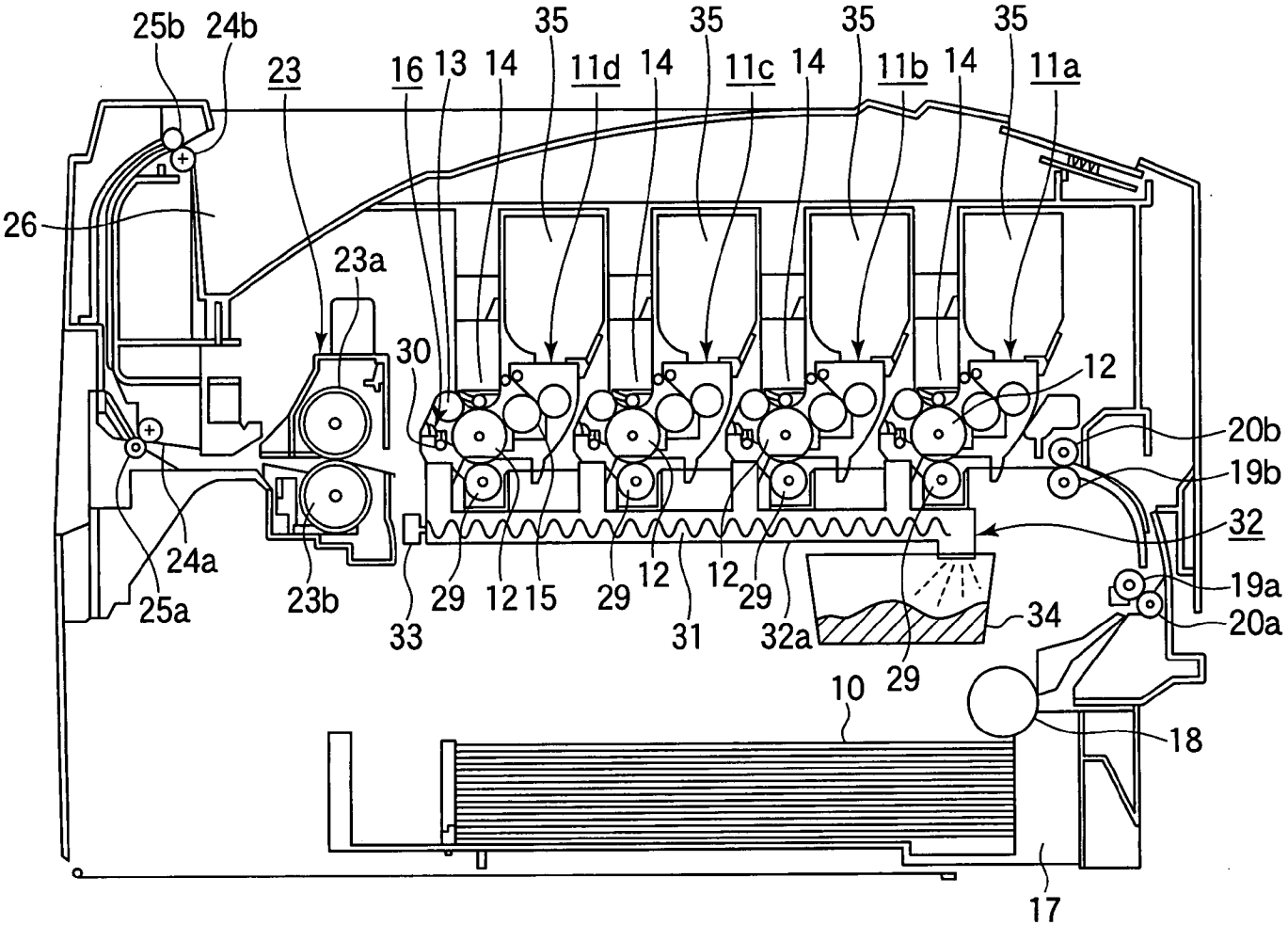
FIG. 1 is a schematic view of an image-forming apparatus according to a first embodiment of the invention.
Figure 2:
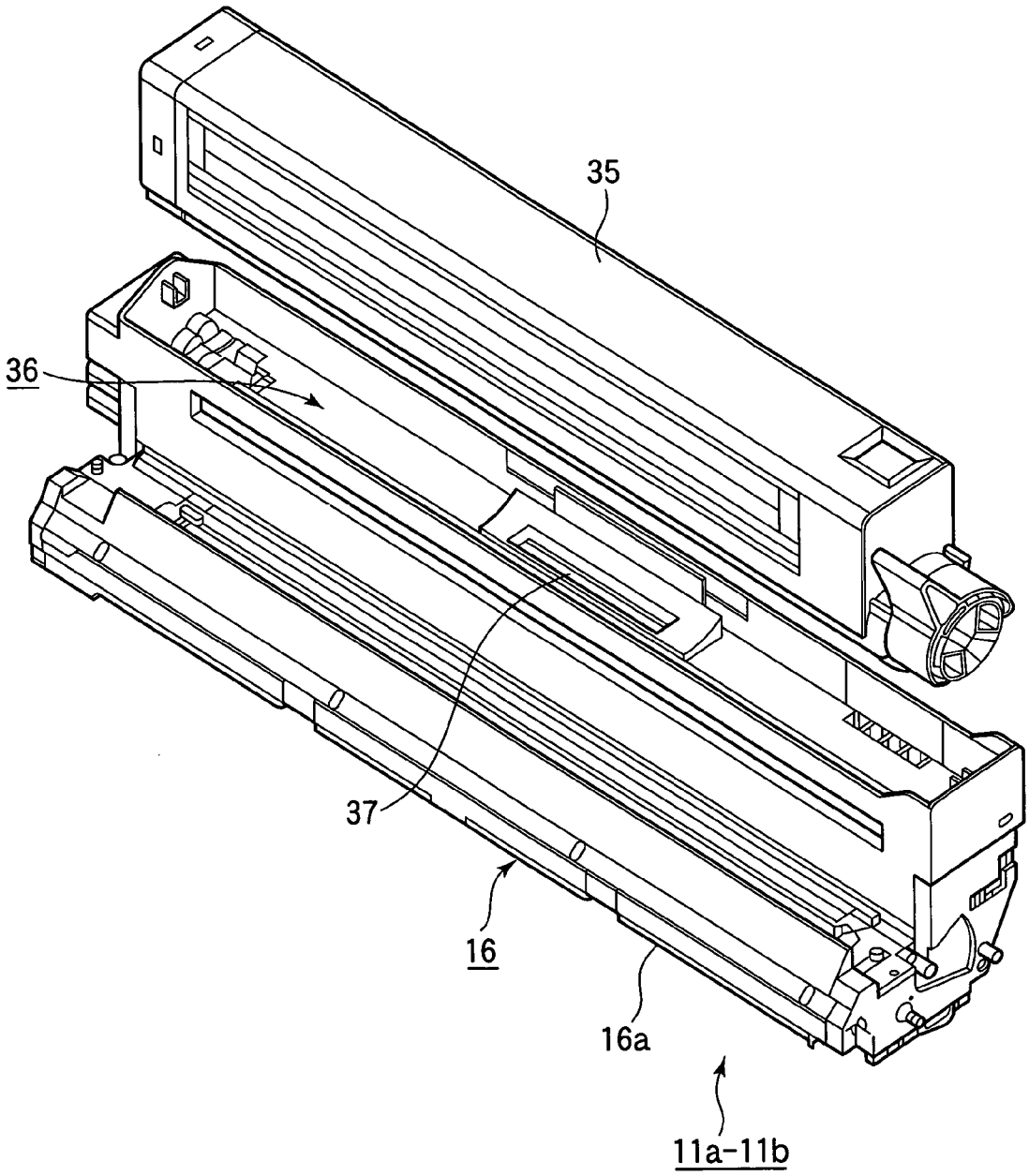
FIG. 2 is an exploded perspective view of one of process units according to the first embodiment.

FIG. 1 is a schematic view of an image-forming apparatus according to a first embodiment of the invention. FIG. 2 is an exploded perspective view of one of process units according to the first embodiment.

Referring to FIGS. 1 and 2, the image-forming apparatus incorporates four process units 11*a*–11*d* aligned in tandem for forming yellow, magenta, cyan and black images, respectively. A toner cartridge 35 is detachably attached to a corresponding one of the process units 11*a*–11*d*. Each of the process units includes amounting portion 36 that receives the toner cartridge 35 therein. The mounting portion 36 has a toner-receiving opening 37 formed therein. An exposing unit 14 and a transfer unit 29 are disposed adjacent to a corresponding one of the process units 11*a*–11*d*. Each of the process units includes a photoconductive drum 12, around which a charging roller 13, a developing unit 15, and a cleaning unit 16 are disposed. The cleaning unit 16 acts as a developer-discharging unit in the present invention.

With the aforementioned image-forming apparatus, a drive source and gears, not shown, drive the photoconductive drum 12 in rotation. The charging roller 13 uniformly charges the entire surface of the photoconductive drum 12. The exposing unit 14 irradiates the charged surface of the photoconductive drum 12 with light to form an electrostatic latent image. The developing unit 15 develops the electrostatic latent image with toner into a toner image. For this purpose, fresh, unused toner is supplied from the toner cartridge 35 to the developing unit 15.

Figure 3:
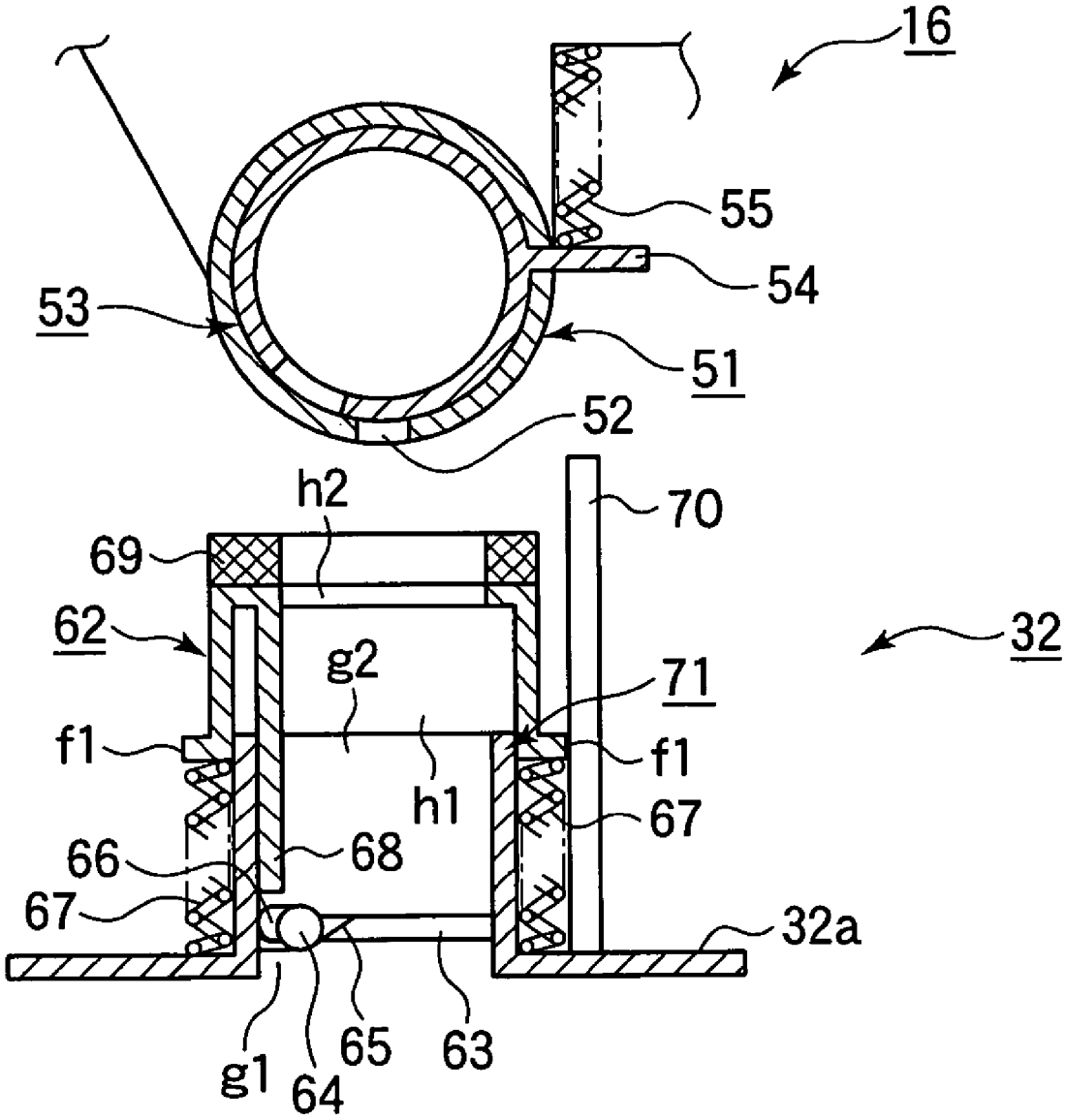
FIG. 3 illustrates the interface according to the first embodiment.

The transfer roller 29 transfers the toner image onto a recording medium 10 such as paper fed from a paper cassette 17. Some toner fails to be transferred and remains on the photoconductive drum 12. The residual toner on the photoconductive drum 12 is removed by the cleaning unit 16. The cleaning unit 16 includes a case 16*a*, a blade (not shown), and a spiral conveyor 30 (FIG. 3). The blade is mounted on the case 16*a* in such a way that an edge of the blade abuts the surface of the photoconductive drum 12. The spiral conveyor 30 rotates about its longitudinal axis and extends in parallel to a rotational axis of the photoconductive drum 12. The spiral conveyor 30 is driven in rotation by a motor, not shown, and transports waste toner (residual toner) scraped from the photoconductive drum 12 to the cleaning unit 16. The case 16*a* is a part of the case of one of the process units 11*a*–11*d*. The paper cassette 17 holds a stack of the recording medium 10 therein. A hopping roller 18 is disposed over the stack of the recording medium 10 to feed the recording medium 10 on a page-by-page basis into a medium transport path. There are provided a feed roller 19*a* and a pinch roller 20*a* downstream of the hopping roller 18, and registry rollers 19*b* and pinch roller 20*b* downstream of the feed rollers 19*a* and pinch roller 20*a*. The feed roller 19*a* and pinch roller 20*a* hold the recording medium 10 between them, and rotate in contact with each other to advance the recording medium 10 to the registry roller 19*b* and pinch roller 20*b*. The feed rollers 19*a* and 19*b* cooperate with pinch rollers 20*a* and 20*b* to remove skew of the recording medium 10. In other words, the registry roller 19*b* and pinch roller 20*b* are first stopped. Then, the feed roller 19*a* and pinch roller 20*a* feed the recording medium 10 forward until the entire leading edge of the recording medium 10 abuts the registry roller 19*b* and pinch roller 20*b*. Subsequently, the registry roller 19*b* and pinch roller 20*b* rotate to advance the recording medium 10. The hopping roller 18 and registry rollers 19*a* and 19*b* are operatively driven in rotation by a drive motor, not shown.

A fixing unit 23 includes a heat roller 23*a* and a pressure roller 23*b*. The fixing roller 23 and pressure roller 23*b* apply heat and pressure to the toner image that has been transferred onto the recording medium 10, thereby fixing the toner image into a permanent image. After fixing, the recording medium 10 leaves the fixing unit 23. Discharging rollers 24*a* and 24*b* and pinch rollers 25*a* and 25*b* cooperate with one another to hold the recording medium in sandwiched relation and are rotated by a motor, not shown, to discharge the recording medium 10 out of the image-forming apparatus.

{Operation of Image Forming Apparatus}

The operation of the aforementioned image-forming apparatus will be described. The hopping roller 18 feeds a top page of the stack of recording medium held in the paper cassette 17. The feed roller 19*a* and pinch roller 20*a* cooperate with the registry roller 19*b* and pinch roller 20*b* to hold each page of the recording medium 10 between them in sandwiched relation. Then, the feed roller 19*a*, pinch roller 20*a*, registry roller 19*b*, and pinch roller 20*b* rotate to feed the recording medium 10 to a transfer point defined between the photoconductive drum 12 and the transfer roller 29 of the process unit 11*a*. Then, a yellow toner image is transferred onto recording medium 10.

Subsequently, the recording medium 10 passes through the process units 11*b*–11*d* in sequence so that the magenta, cyan, and black toner images are transferred onto the recording medium 10 in registration to form a full color toner image.

Then, the fixing unit 23 fixes the full color toner image into a full color permanent image. Subsequently, the recording medium 10 is held in sandwiched relation between the discharging roller 24*a* and the pinch roller 25*a*. The discharging roller 24*a* and the pinch roller 25*a* rotate to transport the recording medium 10 to the discharging roller 24*b* and the pinch roller 25*b*, which in turn discharge the recording medium 10.

As described previously, the spiral conveyor 30 transports the waste toner, removed from the photoconductive drum 12, to one end of the cleaning unit 16. The toner is then received in a toner-receiving unit 32, which in turn supplies the waste toner to a waste toner tank 34. The waste toner tank 34 is detachably mounted to the image-forming apparatus. The toner-receiving unit 32 acts as a developer-receiving unit in the present invention.

The toner-receiving unit 32 includes a hollow cylindrical case 32*a*, a spiral conveyor 31, and a motor 33. The hollow cylindrical case 32*a* extends in a direction in which the recording medium 10 is transported, and serves as a toner-transporting path. The spiral conveyor 31 rotates in the case 32*a* to transport the toner. The motor 33 drives the spiral conveyor 31 in rotation. When the motor 33 drives the spiral conveyor 31, the waste toner removed from photoconductive drums 12 in the process units 11*a*–11*d* is transported in the case 32*a* in the opposite direction to the recording medium 10. In other words, the waste toner is transported to an upstream end with respect to the direction of travel of the recording medium 10.

{Interface between Cleaning Unit and Toner Receiving Unit}

The interface between the cleaning unit 16 and the toner-receiving unit 32 will be described. In the first embodiment, the cleaning unit 16 cooperates with the toner-receiving unit 32 to form a developer transporting system according to the invention.

Figure 4:
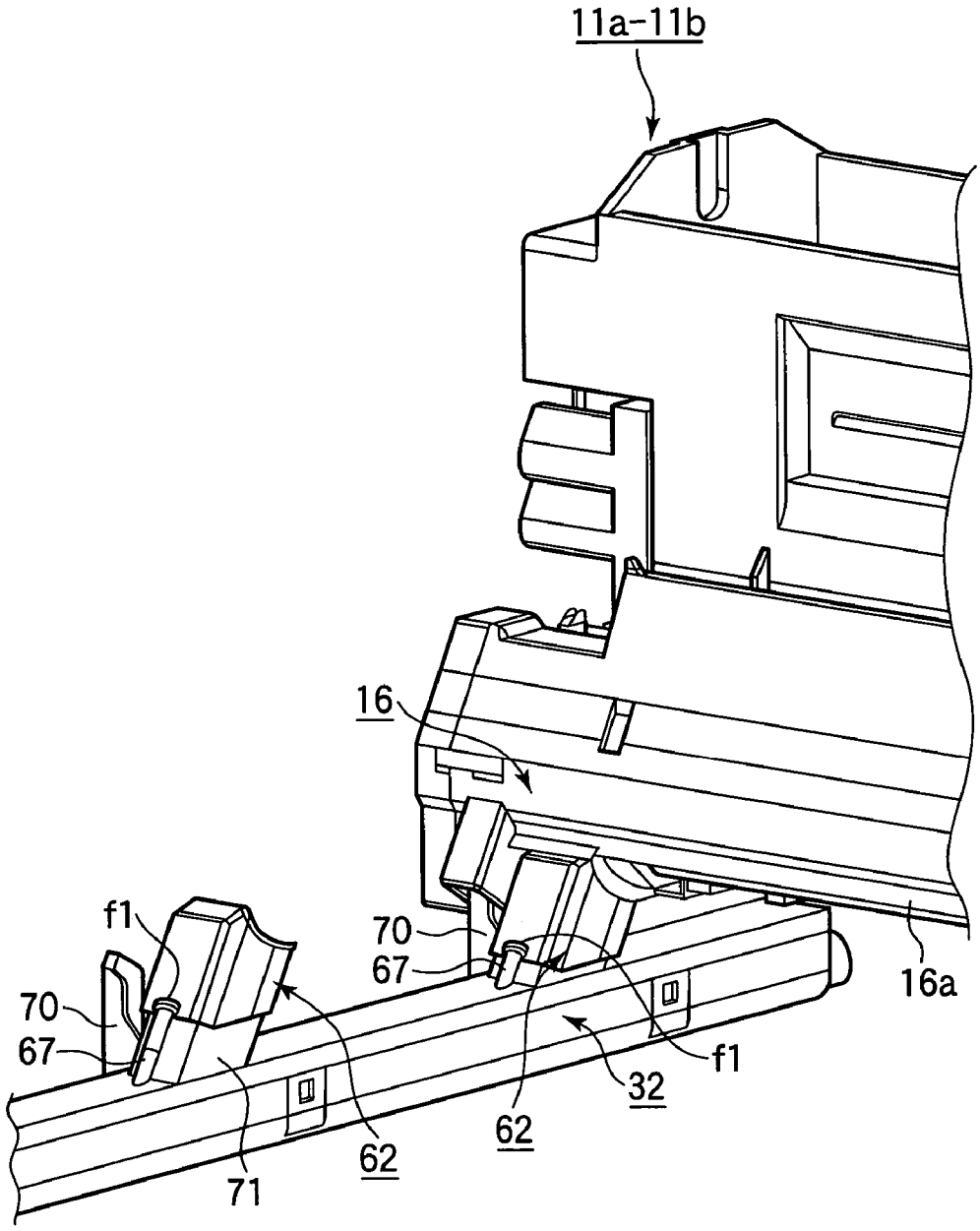
FIG. 4 is a perspective view of the interface and its surroundings.
Figure 5:
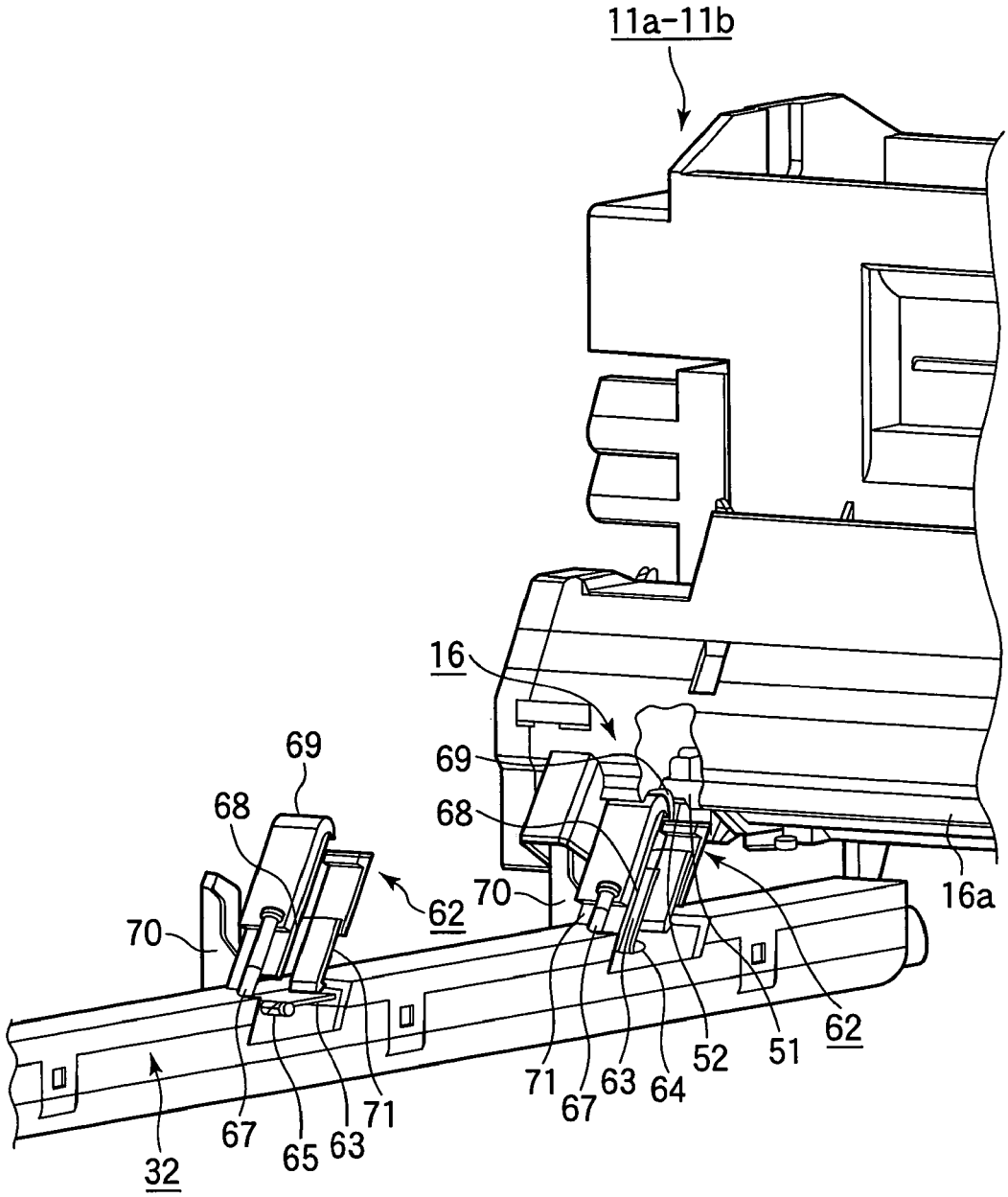
FIG. 5 is a partial cross-sectional view illustrating the interface and its surroundings.
Figure 6:
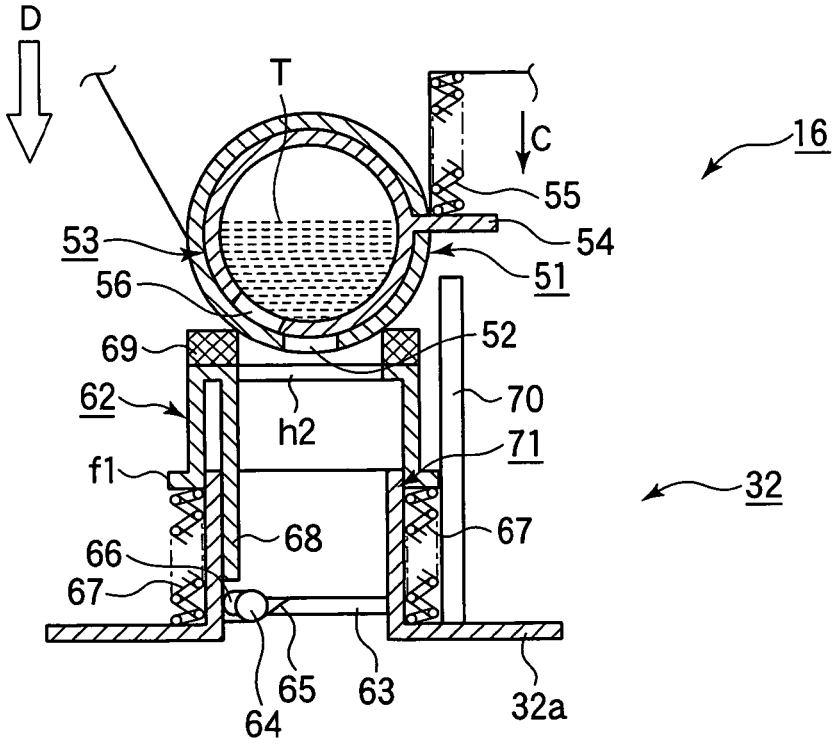
FIG. 6 is a cross sectional view illustrating the interface according to the first embodiment.

FIG. 3 illustrates the interface according to the first embodiment. FIG. 4 is a perspective view of the interface and its surroundings. FIG. 5 is a partial cross-sectional view illustrating the interface and its surroundings. FIG. 6 is a cross sectional view illustrating the interface according to the first embodiment.

Referring to FIG. 6, a hollow cylinder 51 is provided to form a toner path through which the waste toner is transported to the toner-receiving unit 32. There is an opening 52 formed in a bottom of the hollow cylinder 51. A shutter 53 is in the shape of a hollow-cylinder and has an opening 56 formed therein. The shutter 53 fits rotatably and slidably in the hollow cylinder 51, so that when the shutter 53 is rotated, the opening 56 moves into or out of alignment with the opening 52 depending on the position of the shutter 53 relative to the hollow cylinder 51.

In order to open and close the shutter 53, there is provided a lever 54 that projects radially outwardly through the cylinder 51. The lever 54 is urged by a spring 55 in such a direction (arrow C) as to close the shutter 53. The lever 54 is limited its rotational position by a stopper, not shown. The spring 55 is mounted between the lever 54 and a permanent portion of the cleaning unit 16.

The toner-receiving unit 32 includes a hollow cylinder 71 through which the waste toner is received, the hollow cylinder 71 being located immediately under the opening 52 of the cleaning unit 16. A hollow cylinder 62 slidably fits over the hollow cylinder 71. The hollow cylinders 71 and 62 have a rectangular cross section. The hollow cylinder 71 has a lower opening h1 at its lower end and an upper opening h2 at its upper end. The hollow cylinder 62 has a lower opening g1 at its lower end and an upper opening g2 at its upper end.

The hollow cylinder 62 has an inner dimension (perimeter) slightly larger than an outer dimension (perimeter) of the hollow cylinder 71 so that the outer surface of the hollow cylinder 71 can slide on the inner surface of the hollow cylinder 62. The hollow cylinder 62 has projections f1 at a location close to the lower opening h1, the projections f1 radially outwardly projecting in the opposite directions. Springs 67 are mounted between the projections f1 and the case 32*a* in such a way that the springs 67 urge the hollow cylinder 62 toward the cleaning unit 16. The hollow cylinders 71 and 62 and the springs 67 cooperate to form a telescopic toner path, the springs 67 urging the hollow cylinder 62 in such a direction as to stretch the "telescope".

A shutter 63 is mounted to a lower end portion of the hollow cylinder 71, being on an inner surface of the hollow cylinder 71. When a short lever 66 is operated, the shutter 63 pivots about a shaft 64 to open and close the lower opening g1 and h1 and the upper opening g2 and h2. A torsion spring 65 is mounted on the shaft 64 and urges the shutter 63 in such a direction as to close the shutter 63.

The hollow cylinder 62 has an engagement portion 68 that extends along the inner wall of the hollow cylinder 71 from the upper opening h2 to the lower opening h1. When the hollow cylinder 62 is moved toward the case 32*a* against the urging force of the springs 67, the engagement portion 68 pushes the short lever 66 to open the shutter 63. A projection 70 extends upwardly in parallel to the axial directions of the hollow cylinders 71 and 62 from the case 32*a* toward the lever 54 of the cleaning unit 16. An abutting member 69 is formed of a resilient material such as sponge and is disposed on the hollow cylinder 62 to surround the opening 52 formed in the underside of the hollow cylinder outer opening h2. The abutting member 69 surrounds completely all around the opening 52.

The operation of the engagement portions of the aforementioned configuration will be described.

Figure 7:
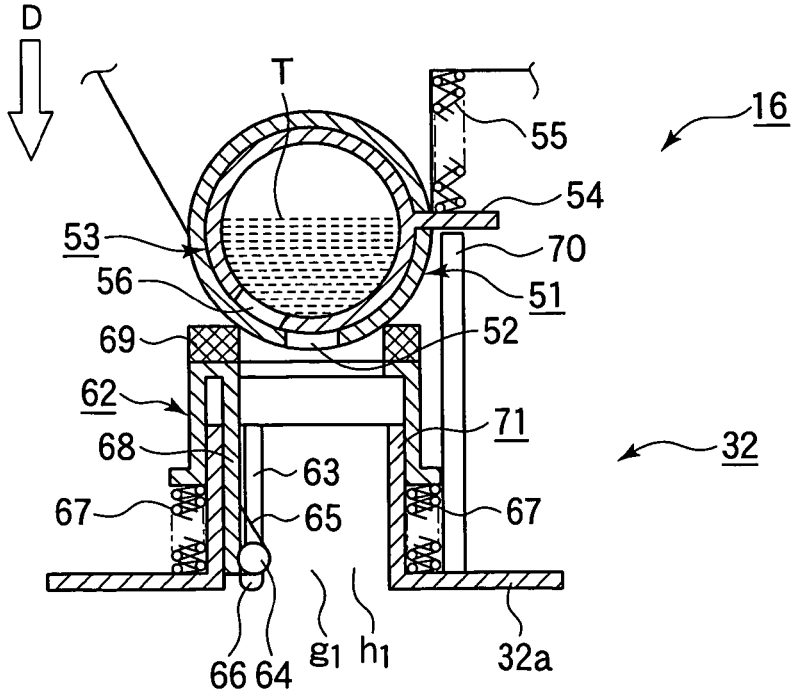
FIG. 7 illustrates the interface according to the first embodiment.
Figure 8:
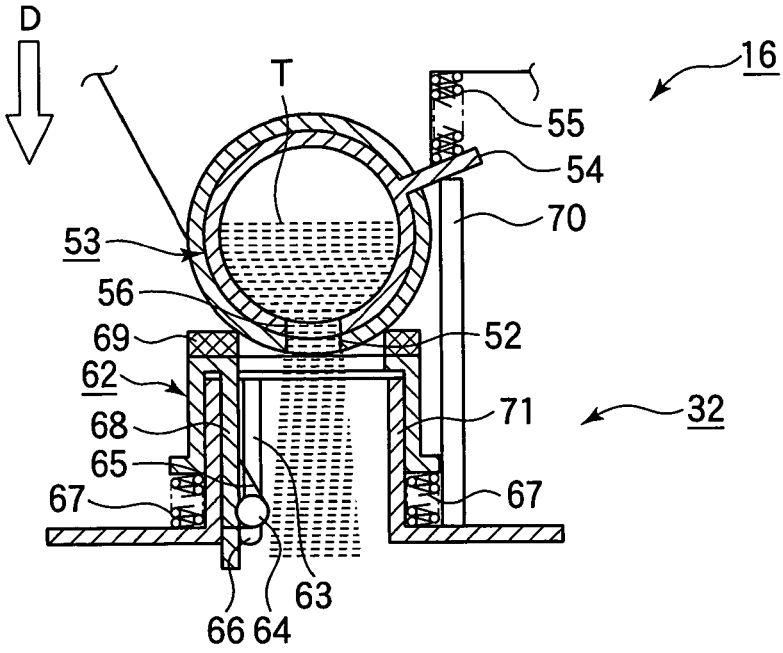
FIG. 8 illustrates the interface according to the first embodiment.

FIG. 7 illustrates the interface according to the first embodiment. FIG. 8 illustrates the interface according to the first embodiment.

When process units 11*a*–11*d* (FIG. 1) are attached to the image-forming apparatus, the cleaning unit 16 is also attached to the toner-receiving unit 32. Referring to FIG. 6, the cleaning unit 16 is first moved in a direction shown by arrow D. A bottom portion of the hollow cylinder 51 is brought into intimate contact with the abutting member 69, so that the opening 52 and the upper opening h2 are completely sealed against the environment. At this moment, the shutters 53 and 63 are at their closed positions and therefore the toner T is sealed in the cleaning unit 16.

As the cleaning unit 16 moves further in the D direction as shown in FIG. 7, the hollow cylinder 62 also moves against the urging force of the spring 67 while the hollow cylinder 51 is in intimate contact with the abutting member 69. The engagement portion 68 pushes the short lever 66 causing the shutter 63 to open against the urging force of the torsion spring 65. At this moment, the projection 70 abuts the lever 54.

As shown in FIG. 8, when the cleaning unit 16 is further moved in the D direction, the projection 70 pushes up the lever 54 against the urging force of the spring 55. It is to be noted that the projection 70 pushes up the lever 54 against the urging force of the spring 55 to open the opening 52 only after the shutter 80 is opened completely or sufficiently. When the opening 52 is opened, the toner T is discharged from the cleaning unit 16 through the openings 56 and 52 into the toner-receiving unit 32.

In this case, the shutter 53 opens only when the shutter 63 opens at least sufficiently, ensuring that the toner T falls into the toner-receiving unit 32. Thus, the outer surface of the cleaning unit 16 does not become contaminated with the toner T.

{Detaching Cleaning Unit}

A description will now be given of the operation in which the cleaning unit 16 is detached from the toner-receiving unit 32 when the process units 11*a*–11*d* are detached from the image forming apparatus. When the cleaning unit 16 moves in a direction opposite to arrow D, the urging force of the spring 55 causes the lever 54 to move toward the toner-receiving unit 32 to close the shutter 53.

The urging force of the spring 67 causes the hollow cylinder 62 to move toward the cleaning unit 16 while the hollow cylinder 51 is in intimate contact with the abutting member 69. The projection 68 moves out of engagement with the lever 66, so that the urging force of the torsion spring 65 causes the shutter 63 to close. At this moment, the cylinder 51 is still in intimate contact with the abutting member 69 so that the opening 52 and the upper opening h2 are completely sealed. Thus, the toner T does not leak nor does it scatter due to the opening and closing operations of the shutter 63.

In the first embodiment, when the cleaning unit 16 is mounted to the toner-receiving unit 32, the shutter 63 on the toner-receiving unit 32 side is opened only after the cylinder 51 and abutting member 69 engage with each other to completely seal the opening 52 and the upper opening h2 against the environment. Subsequently, the shutter 53 on the cleaning unit 16 side is opened. When the cleaning unit 16 is dismounted from the toner-receiving unit 32, the shutter 53 on the cleaning unit 16 side is opened with the cylinder 51 and abutting member 69 completely sealing against the environment. Then, the shutter 53 on the toner-receiving unit 32 side is closed. Thus, the toner T does not leak nor does it scatter due to the opening and closing operations of the shutter 63.

Second Embodiment

Elements similar to those in the first embodiment have been given the same reference numerals and the description thereof is omitted.

Figure 9:
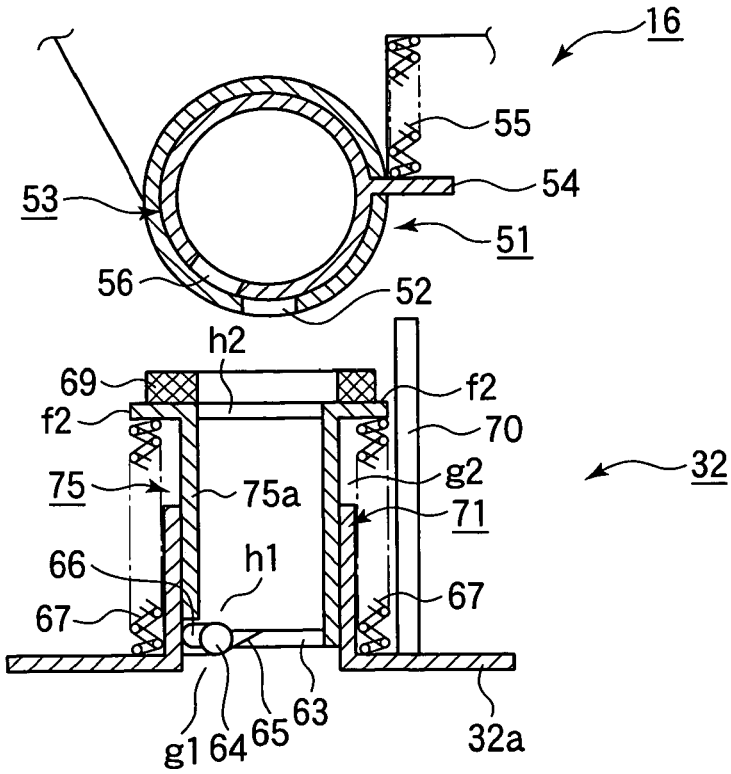
FIG. 9 illustrates the interface according to a second embodiment.

FIG. 9 illustrates the interface according to a second embodiment. Referring to FIG. 9, a toner-receiving unit 32 has a hollow cylinder 71 provided to receive toner T (FIG. 6), the hollow cylinder 71 being in alignment with an opening 52 formed in a cleaning unit 16. A hollow cylinder 75 slidably fits in the hollow cylinder 71. The hollow cylinders 71 and 76 have a rectangular cross section. The hollow cylinder 71 has a lower opening h1 at its lower end and an upper opening h2 at its upper end. The hollow cylinder 62 has a lower opening g1 at its lower end and an upper opening g2 at its upper end. The cleaning unit 16 and the toner-receiving unit 32 cooperate to form a developer transporting system according to the invention.

The hollow cylinder 75 has an outer diameter slightly smaller than an inner diameter of the hollow cylinder 71 so that the outer surface of the hollow cylinder 75 can slide on the inner surface of the hollow cylinder 71 smoothly. The hollow cylinder 75 has projections f2 at a location close to the lower opening h2, the projections f2 projecting radially outwardly. Springs 67 are mounted between the projections f2 and a case 32*a* so that the springs 67 urge the hollow cylinder 75 toward the cleaning unit 16.

A shutter 63 is mounted to a lower end portion of the hollow cylinder 71, being pivotal about a shaft 64. A torsion spring 65 is mounted on the shaft 64 and urges the shutter 63 in such a direction as to close the shutter 63. A lever is provided to the shutter 63 and is operated to cause the shutter 63 to open and close. When a lever 66 is operated to open or close the shutter 63, the lower opening g1 and h1 and the upper openings g2 and h2 are opened or closed.

When the hollow cylinder 75 is moved against the urging force of the spring 67 while the hollow cylinder 51 is in intimate contact with the abutting member 69, one end 75*a* of the hollow cylinder 75 pushes the lever 66 against the urging force of the torsion spring 65. This causes the shutter 63 to open.

The rest of the operation is the same as that of the first embodiment and the description is omitted.

As described above, the second embodiment is configured such that the hollow cylinder 75 fitted into the hollow cylinder 71 and the shutter opens when the lever 66 pushes one end 75*a* of the hollow cylinder 75. This configuration simplifies the construction of the hollow cylinder 75. In addition, the toner T that falls in the hollow cylinder 75 does not leak.

Third Embodiment

Elements similar to those in the second embodiment have been given the same reference numerals and the description thereof is omitted.

{Construction}

Figure 10:
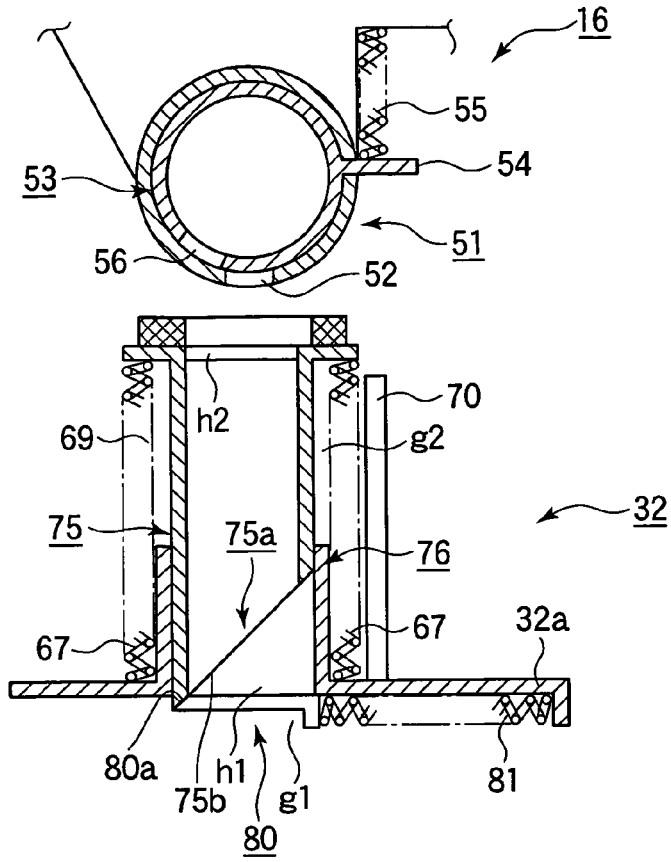
FIG. 10 illustrates the interface according to a third embodiment.

FIG. 10 illustrates the interface according to a third embodiment. Referring to FIG. 10, a toner-receiving unit 32 has a hollow cylinder 76 is provided for receiving toner T (FIG. 6), the hollow cylinder 76 being in alignment with an opening 52 of a cleaning unit 16 side. A hollow cylinder 75 slidably fits into the hollow cylinder 76. The hollow cylinders 75 and 76 have a rectangular cross section. The hollow cylinder 71 has a lower opening h1 at its lower ends and an upper opening h2 at its upper end. The hollow cylinder 62 has a lower opening g1 at its lower end and an upper opening g2 at its upper end. The cleaning unit 16 and the toner-receiving unit 32 cooperate to form a developer transporting system according to the invention.

The hollow cylinder 75 has an outer diameter slightly smaller than an inner diameter of the hollow cylinder 76 so that the outer surface of the hollow cylinder 75 can slide on the inner surface of the hollow cylinder 76. The hollow cylinder 75 has projections f2 at locations close to the lower opening h2, the projection f2 radially outwardly projecting. Springs 67 are mounted between the projections f2 and a case 32*a* so that the springs 67 urge the hollow cylinder 75 toward the cleaning unit 16.

The hollow cylinder 75 has a guide surface (beveled surface) 75*b* at its one end 75*a*, the guide surface 75*b* being at an angle (about 45 degrees) with a direction in which the hollow cylinder 75 moves. A shutter 80 is supported by a supporting member, not shown, to close and open a lower opening g1 of the hollow cylinder 76, being on the inner side of the case 32*a*. The shutter 80 moves in a direction perpendicular to a direction of movement of the hollow cylinder 75, thereby opening and closing the lower openings g1 and h1. For this purpose, the shutter 80 has a guide surface (beveled surface) 80*a* at its one end, the guide surface being inclined at the same angle as the guide surface 75*b*.

A spring 81 is disposed adjacent to the shutter 80 on the inner side of the case 32*a*, urging the shutter 80 in such a direction as to close the lower openings g1 and h1. When the hollow cylinder 75 moves toward the toner-receiving unit 32 against the urging force of the spring 67, the guide surface 75*b* moves into engagement with the shutter 80. The guide surface 75*b* cams the guide surface 80*a* to move the shutter 80 out of the way so that shutter 80 is opened against the urging force of the spring 81.

{Attaching Cleaning Unit}

Figure 11:
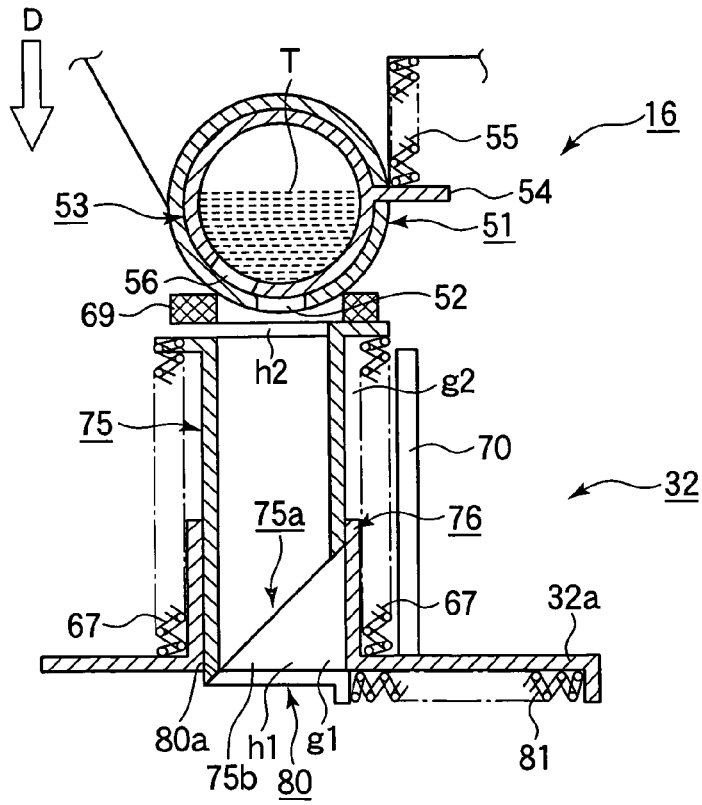
FIGS. 11–13 illustrate the interface according to the third embodiment.
Figure 12:
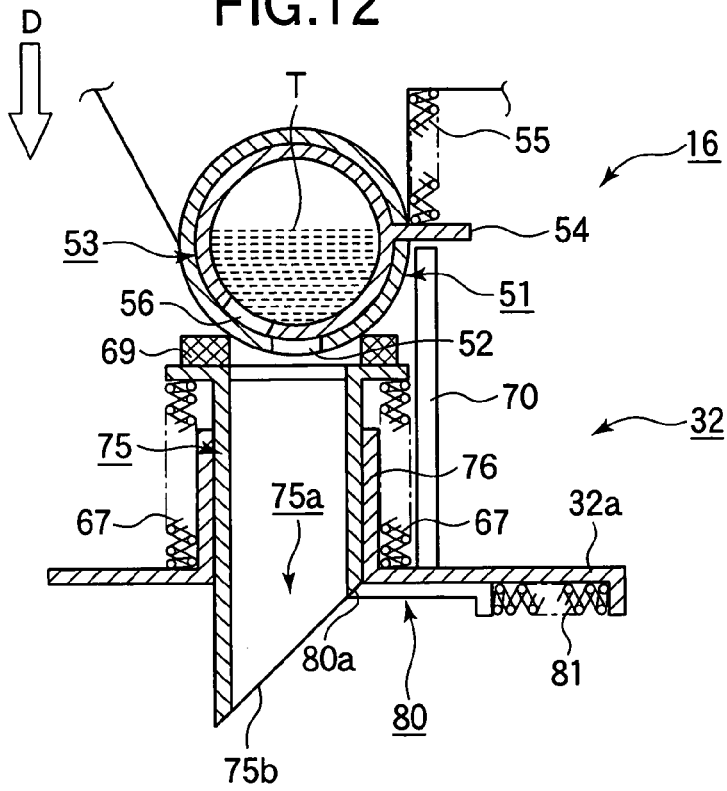
Figure 13:
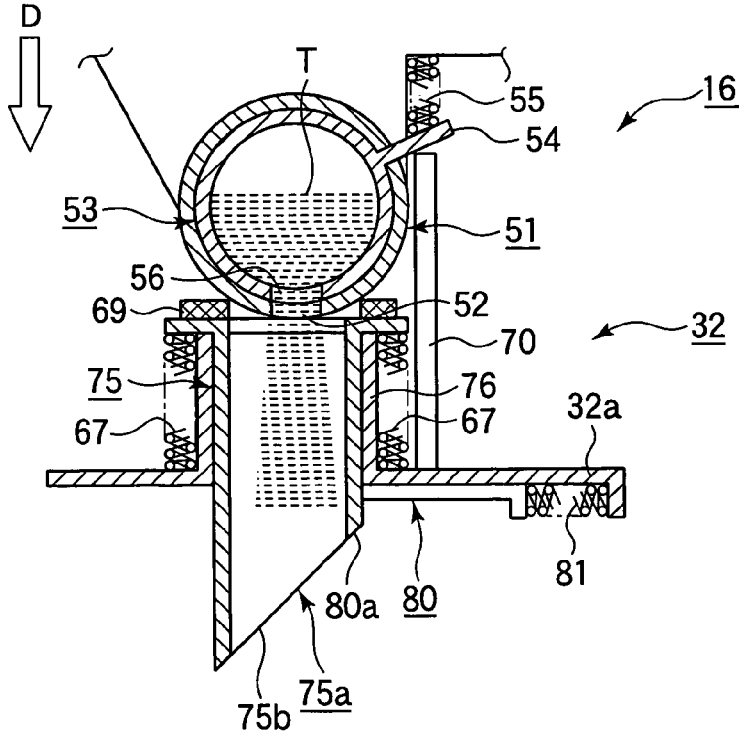
Figure 14:
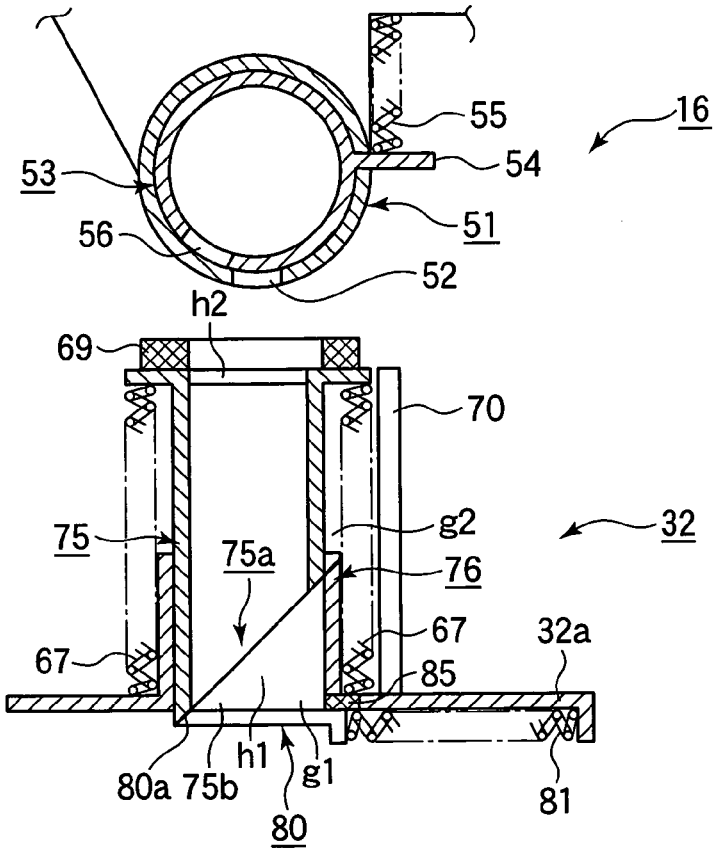
FIGS. 14–17 illustrate an interface according to a fourth embodiment.

The operation of the interface of the aforementioned configuration will be described. FIGS. 11-13 illustrate the interface according to the third embodiment.

When the process units 11*a*–11*d* (FIG. 1) are attached to an image forming apparatus, the cleaning unit 16 is also attached to the toner-receiving unit 32. Referring to FIG. 11, when the cleaning unit 16 is moved toward the toner-receiving unit 32 in a direction shown by arrow D, the hollow cylinder 51 is brought into intimate contact with the abutting member 69. This allows the opening 52 and the upper opening h2 to be completely sealed against the environment. At this moment, the shutters 53 and 80 are closed and therefore the toner T remains sealed in the cleaning unit 16.

As the cleaning unit 16 moves further in the D direction as shown in FIG. 12, the hollow cylinder 51 also moves against the urging force of the spring 67 while the hollow cylinder 51 is in intimate contact with the abutting member 69. The guide surface 75*b* pushes the guide surface 80*a*, causing the shutter 80 to open against the urging force of the torsion spring 81. At this moment, the projection 70 abuts the lever 54.

As shown in FIG. 13, the cleaning unit 16 is further moved in the D direction, the projection 70 pushes up the lever 54 against the urging force of the spring 55. It is to be noted that the projection 70 pushes up the lever 54 against the urging force of the spring 55 to open the opening 52 only after the shutter 80 is opened completely or sufficiently. When the opening 52 is opened, the toner T is discharged from the cleaning unit 16 through the openings 56 and 52 into the toner-receiving unit 32.

As described above, the shutter 53 opens only after the shutter 80 opens at Least sufficiently ensuring that the toner T falls into the toner-receiving unit 32. Thus, the outer surface of the cleaning unit 16 does not become contaminated with the toner T.

{Detaching Cleaning Unit}

A description will be given of the operation in which the cleaning unit 16 is detached from the toner-receiving unit 32 when the process units 11*a*–11*d* are detached from the image-forming apparatus.

When the cleaning unit 16 moves in a direction opposite to arrow D, the urging force of the spring 55 causes the lever 54 to move toward the toner-receiving unit 32 to close the shutter 53.

The urging force of the spring 67 causes the hollow cylinder 75 to move toward the cleaning unit 16 while the hollow cylinder 51 is in intimate contact with the abutting member 69. At this moment, the cylinder 51 remains in intimate contact with the abutting member 69, so that the opening 52 and the upper opening h2 are completely sealed against the environment. Thus, the toner T does not leak nor does it scatter due to the opening and closing operations of the shutter 80.

In the third embodiment, when the cleaning unit 16 is mounted to the toner-receiving unit 32, the shutter 80 on the toner-receiving unit 32 side is opened only after the cylinder 51 and the abutting member 69 move into sealed engagement with each other to completely seal the opening 52 and the upper opening h2 against the environment. Subsequently, the shutter 53 on the cleaning unit 16 side is opened.

When the cleaning unit 16 is dismounted from the toner-receiving unit 32, the shutter 53 on the cleaning unit 16 side is closed with the cylinder 51 and abutting member 69 completely sealing against the environment. Then, the shutter 80 on the toner-receiving unit 32 side is closed. Then, the shutter 80 is closed. Thus, the toner T does not leak nor does it scatter due to the opening and closing operations of the shutter 80.

As described above, the hollow cylinder 75 fits in the hollow cylinder 76, so that when the guide surface 75*b* of the hollow cylinder 75 pushes the guide surface 80*a*, the shutter 80 opens. This configuration simplifies the construction of the hollow cylinder 75 and prevents the toner T from leaking when the toner T falls into the toner-receiving unit 32 through the hollow cylinder 75.

Because the shutter 80 opens and closes in a direction perpendicular to a direction in which the toner T falls from the cleaning unit 16 into the toner-receiving unit 32, the shutter 80 does not raise the dust of toner.

Fourth Embodiment

Elements similar to those in the third embodiment have been given the same reference numerals and the description thereof is omitted.

FIGS. 14–17 illustrate an interface according to a fourth embodiment.

There is provided a cleaning element 85 adjacent to a lower opening g1 of a hollow cylinder 76. When a shutter 80 opens and closes the lower opening g1, the cleaning element 85 slides on the surface of the shutter 80 so that the toner particles are cleaned from the shutter 80.

Figure 15:
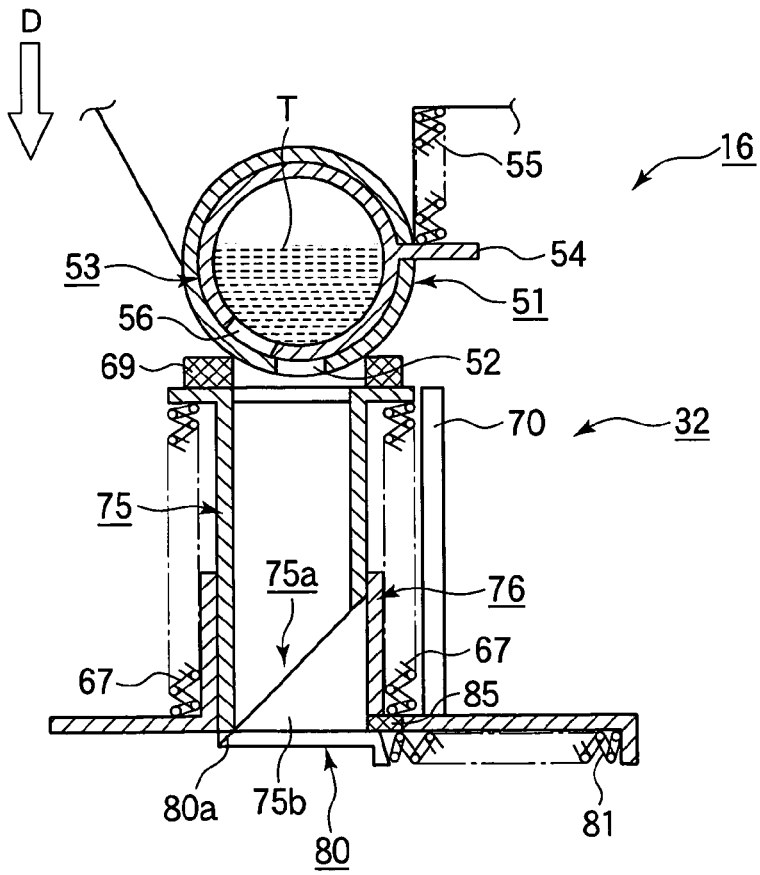

When the process units 11*a*–11*d* (FIG. 1) are attached to an image-forming apparatus, the cleaning unit 16 is also attached to the toner-receiving unit 32. Referring to FIG. 15, when the cleaning unit 16 is moved toward the toner-receiving unit 32 in a direction shown by arrow D, the hollow cylinder 51 is brought into intimate contact with the abutting member 69. This allows the opening 52 and the upper opening h2 to be completely sealed against the environment. At this moment, the shutters 53 and 80 are still closed and therefore the toner T remains sealed in the cleaning unit 16.

Figure 16:
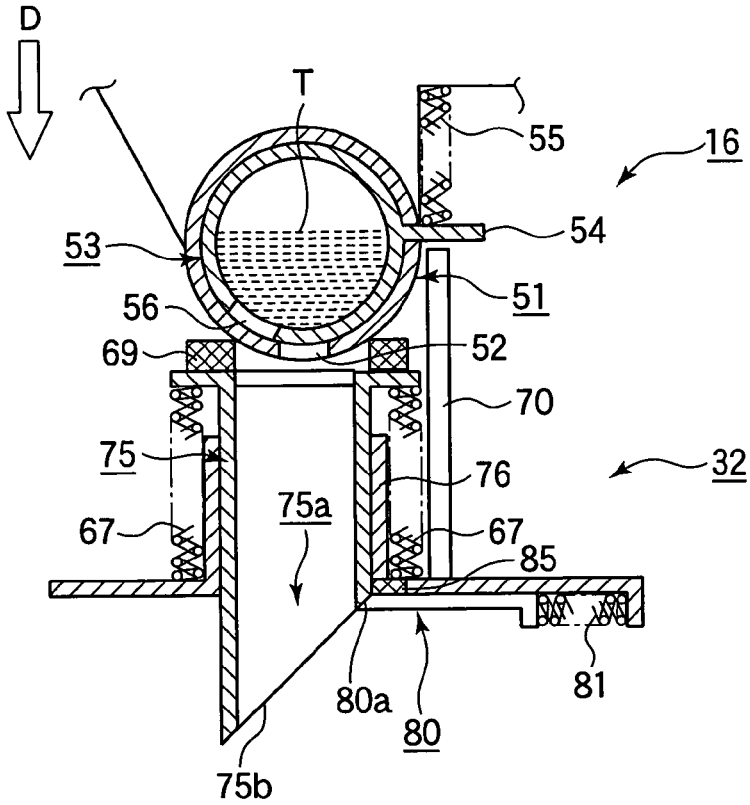

As the cleaning unit 16 moves further in the D direction as shown in FIG. 16, the hollow cylinder 75 also moves against the urging force of the spring 67 while the hollow cylinder 51 is in intimate contact with the abutting member 69. The guide surface (beveled surface) 75*b* pushes the guide surface (beveled surface) 80*a* causing the shutter 80 to open against the urging force of the torsion spring 81. At this moment, the cleaning element rubs the surface of the shutter 80 so that the toner particles are cleaned from the surface of the shutter 80. Also, a projection 70 abuts a lever 54 as shown in FIG. 16.

Figure 17:
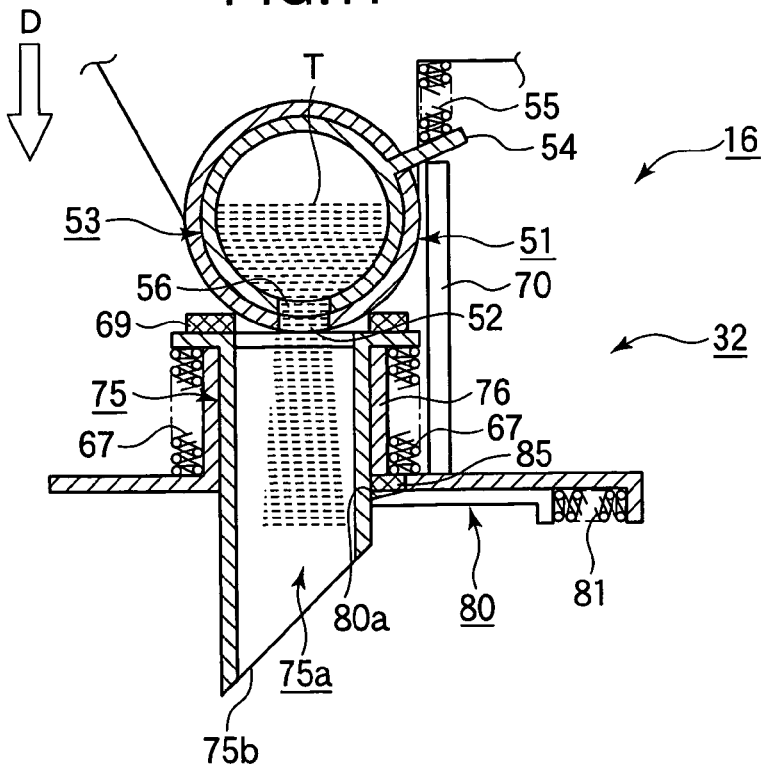

As shown in FIG. 17, as the cleaning unit 16 is moved further in the D direction, the projection 70 pushes the lever 54 against the urging force of a spring 55 only after the shutter 80 is opened completely or sufficiently. As a result, the opening 52 is opened so that the toner T is discharged from the cleaning unit 16 into the toner-receiving unit 32.

It should be noted that the shutter 53 opens only after the shutter 80 opens at least sufficiently, ensuring that the toner T falls into the toner-receiving unit 32 but does not adhere to the outer surface of the shutter 80. Even if the toner may adhere to the outer surface of the shutter 80, the cleaning member 85 rubs it off.

When the process units 11*a*–11*d* are detached from the image-forming apparatus and the cleaning unit 16 is detached from the toner receiving 32, the cleaning member 85 rubs the outer surface of the shutter 80 during the movement of the shutter 80.

In other words, even if the toner T adheres to the outer surface of the shutter 80 for some reason, the toner particles are cleaned from the shutter 80. This prevents the operator's hands from becoming contaminated with the toner. The cleaning unit 16 and the toner-receiving unit 32 cooperate to form a developer transporting system according to the invention.

Fifth Embodiment

Elements similar to those in the first embodiment have been given the same reference numerals and the description thereof is omitted.

Figure 18:
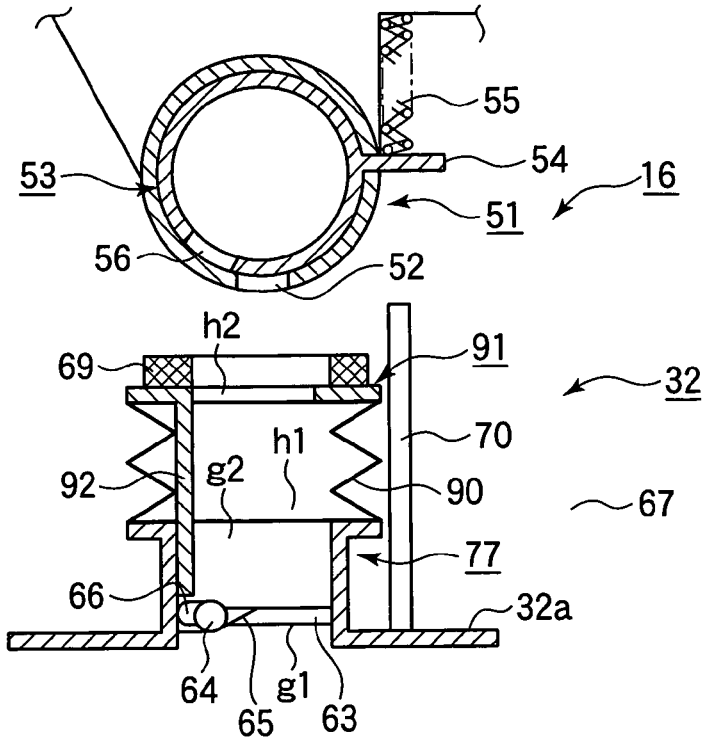
FIG. 18 illustrates an interface according to a fifth embodiment.

FIG. 18 illustrates an interface according to a fifth embodiment. Referring to FIG. 18, a toner-receiving unit 32 has a hollow cylinder 77 is provided to receive toner T, the hollow cylinder 77 being in alignment with an opening 52 of a cleaning unit 16. A hollow cylinder 90 is mounted on the hollow cylinder 77. The hollow cylinder 90 is made of a resilient material in the shape of an accordion and therefore it can expand and contract resiliently. The hollow cylinders 77 and 90 have a rectangular cross section. The hollow cylinder 77 has a lower opening g1 at its lower end and an upper opening g2 at its upper end. The hollow cylinder 90 has a lower opening h1 at its lower end and an upper opening h2 at its upper end. The cleaning unit 16 and the toner-receiving unit 32 cooperate to form a developer transporting system according to the invention.

A generally rectangular loop-like member 91 is mounted on the top of the hollow cylinder 90. When the cleaning unit 16 is brought into contact with the rectangular loop-like member 91, the hollow cylinder 90 urges the cleaning unit 16. The rectangular loop-like member 91 has a projection 92 that extends downwardly from the upper opening h2 toward the lower opening g1. The hollow cylinders 77 and 90 cooperate to form a path of toner that can expand and contract.

A shutter 63 is mounted to a lower end portion of the hollow cylinder 77, being on an inner surface of the hollow cylinder 77. A short lever 66 is provided for operating the shutter 63. When the short lever 66 is operated, the shutter 63 pivots about a shaft 64 to open and close the lower opening g1. A torsion spring 65 is mounted on the shaft 64 and urges the shutter 63 in such a direction as to close the shutter 63.

Figure 19:
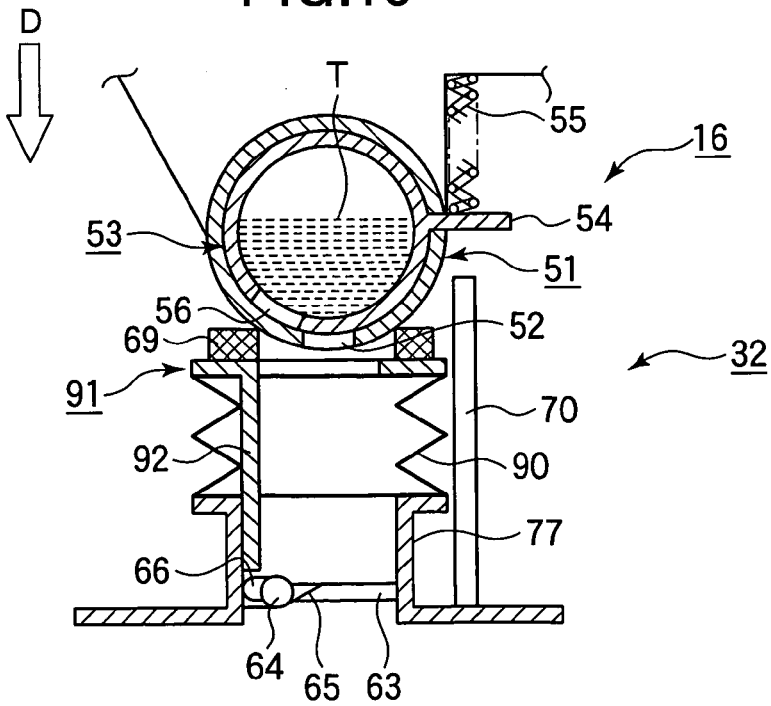
FIGS. 19–21 illustrate the interface according to the fifth embodiment.
Figure 20:
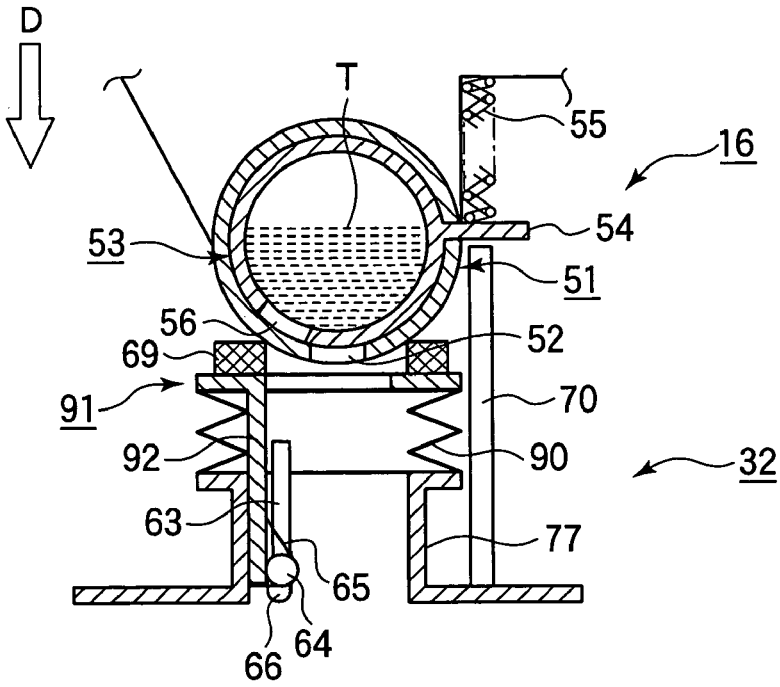
Figure 21:
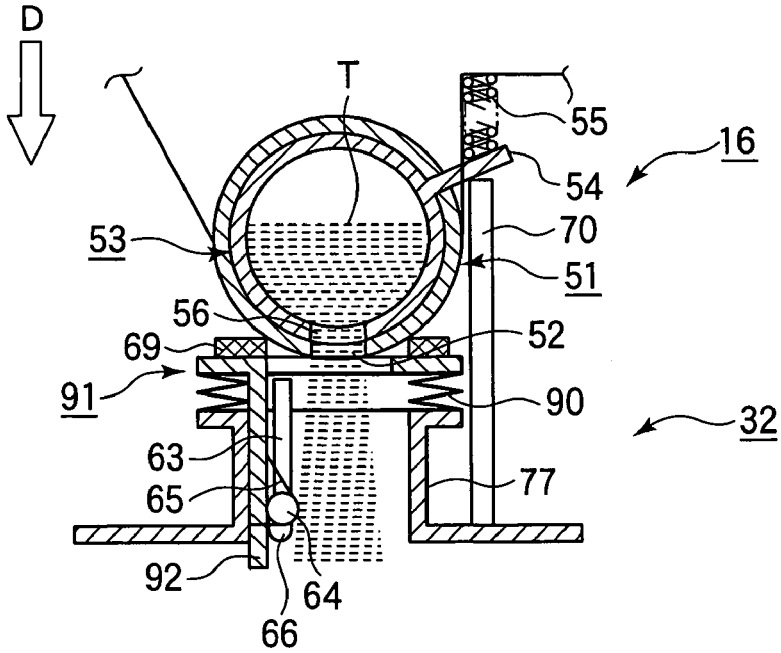

The operation of the interface of the aforementioned configuration will be described. FIGS. 19–21 illustrate the interface according to the fifth embodiment.

{Attaching Cleaning Unit}

When the process units 11*a*–11*d* (FIG. 1) are attached to an image-forming apparatus, the cleaning unit 16 is also attached to the toner-receiving unit 32. Referring to FIG. 19, when the cleaning unit 16 is moved toward the toner-receiving unit 32 in a direction shown by arrow D, the hollow cylinder 51 is brought into intimate contact with the abutting member 69. This allows the opening 52 and the upper opening h2 to be completely sealed against the environment. At this moment, the shutters 53 and 63 are still closed and therefore the toner T remains sealed in the cleaning unit 16.

As the cleaning unit 16 moves further in the D direction as shown in FIG. 20, the hollow cylinder 90 also contracts against its own urging force while the hollow cylinder 51 is in intimate contact with the abutting member 69. The projection 92 pushes the short lever 66 causing the shutter 63 to open. At this moment, the projection 70 abuts the lever 54.

As shown in FIG. 21, the cleaning unit 16 is further moved in the D direction, the projection 70 pushes up the lever 54 against the urging force of the spring 55. It is to be noted that the projection 70 pushes up the lever 54 against the urging force of the spring 55 to open the opening 52 only after the shutter 80 is opened completely or sufficiently.

When the opening 52 is opened, the toner T is discharged from the cleaning unit 16 through the openings 56 and 52 into the toner-receiving unit 32.

In this case, the shutter 53 opens only when the shutter 64 opens at least sufficiently, ensuring that the toner T falls into the toner-receiving unit 32. Thus, the outer surface of the cleaning unit 16 does not become contaminated with the toner T.

{Detaching Cleaning Unit}

A description will be given of the operation in which the cleaning unit 16 is detached from the toner-receiving unit 32 when the process units 11*a*–11*d* are detached from the image-forming apparatus.

When the cleaning unit 16 moves in a direction opposite to arrow D, the urging force of the spring 55 causes the lever 54 to move toward the toner-receiving unit 32 to close the shutter 53.

The urging force of the hollow cylinder 90 causes the loop like member 91 to move toward the cleaning unit 16 while the hollow cylinder 51 is in intimate contact with the abutting member 69. The projection 92 moves out of engagement with the lever 66, so that the urging force of the torsion spring 65 causes the shutter 63 to close. At this moment, the cylinder 51 remains in intimate contact with the abutting member 69, so that the opening 52 and the upper opening h2 are completely sealed against the environment. Thus, the toner T does not leak nor does it scatter due to the opening and closing operations of the shutter 63.

The intimate contact engagement between the hollow cylinder 90 and the hollow cylinder 77 completely prevents the toner T from leaking. Further, the hollow cylinder 90 urges the loop-like member 91 against the cleaning unit 16. This eliminates the need for providing a spring for urging the hollow cylinder against the cleaning unit 16, and simplifies the configuration of the toner-receiving unit 32.

Sixth Embodiment

Elements similar to those in the fifth embodiment have been given the same reference numerals and the description thereof is omitted.

Figure 22:
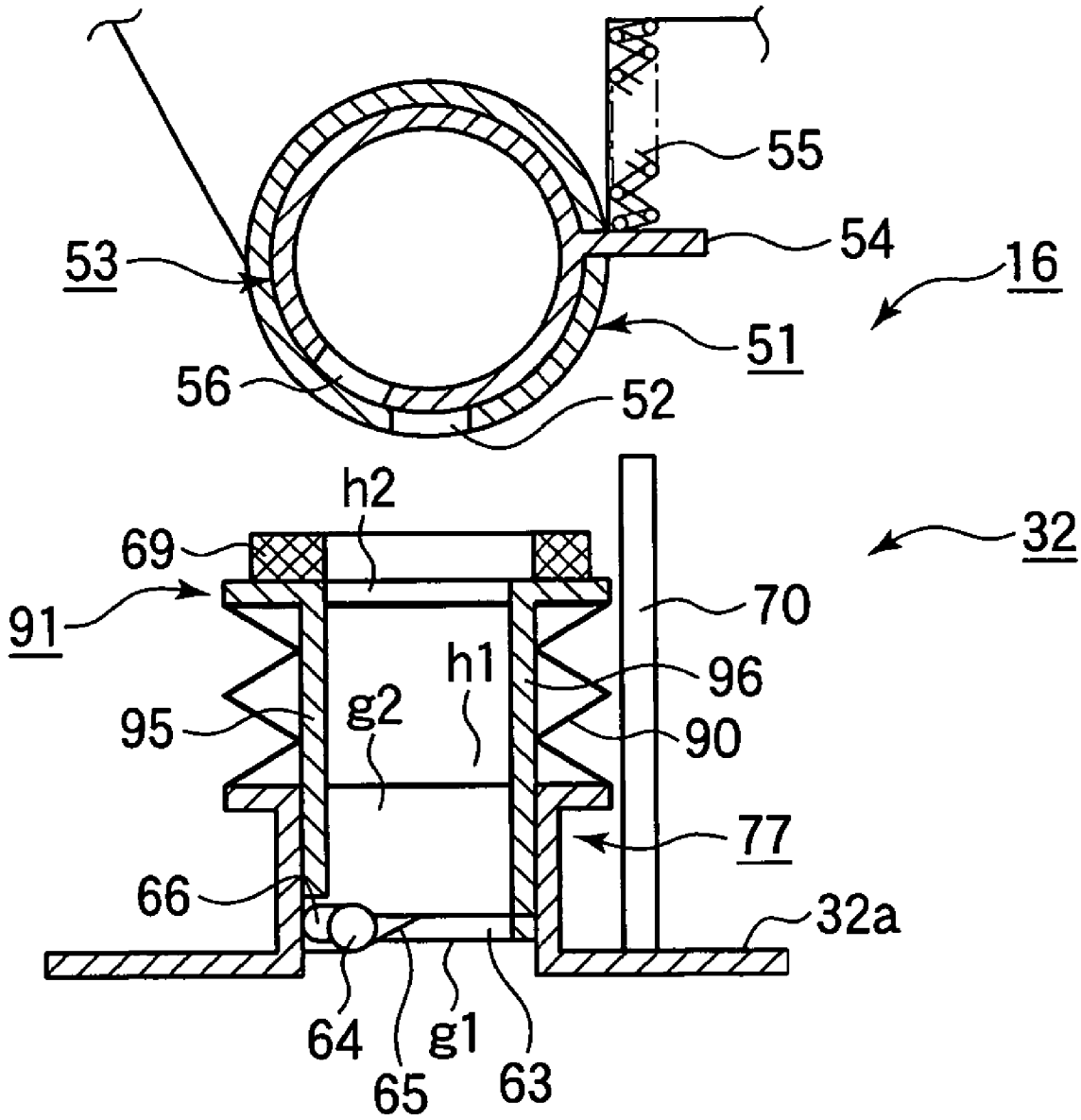
FIG. 22 illustrates an interface according to a sixth embodiment.
Figure 23:
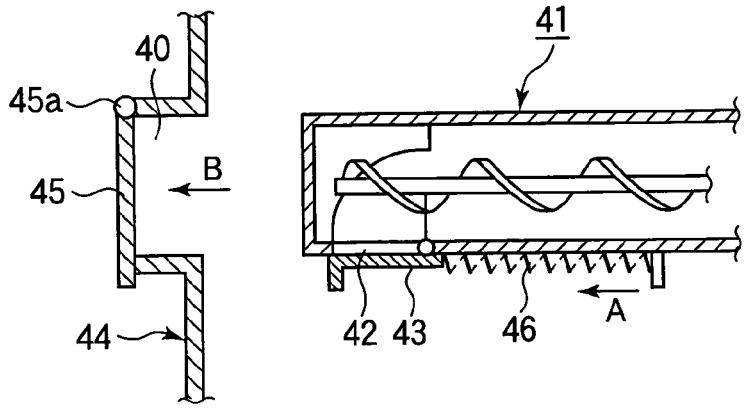
FIG. 23 illustrates a conventional interface between one section and another section.
Figure 24:
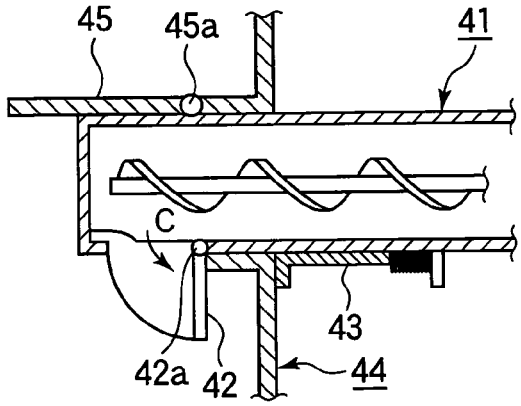
FIG. 24 illustrates two sections in FIG. 23 coupled together.
Figure 25:
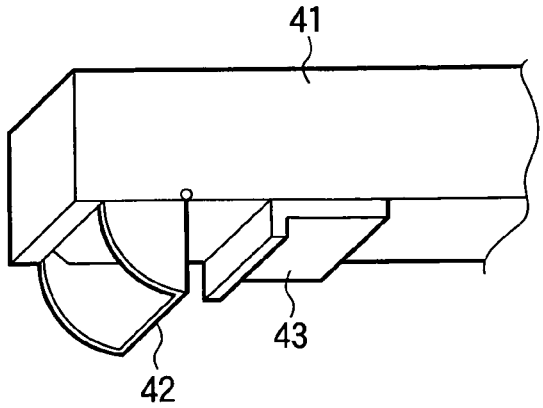
FIG. 25 is a perspective view of the structure FIG. 24.

FIG. 22 illustrates an interface according to a sixth embodiment.

Referring to FIG. 22, a toner-receiving unit 32 has a hollow cylinder 77 provided for receiving toner T, the hollow cylinder 77 being in alignment with an opening 52 of a cleaning unit 16. A hollow cylinder 90 is mounted on the hollow cylinder 77. The hollow cylinder 90 is formed of a resilient material in the shape of an accordion and therefore it can expand and contract resiliently. The hollow cylinders 77 and 90 have a rectangular cross section. The hollow cylinder 77 has a lower opening g1 at its lower end and the hollow cylinder 90 has a lower opening h1 at its lower end and an upper opening h2 at its upper end. The cleaning unit 16 and the toner-receiving unit 32 cooperate to form a developer transporting system according to the invention.

A rectangular loop-like member 91 is mounted on the top of the hollow cylinder 90. When the cleaning unit 16 is brought into pressure contact with the rectangular loop-like member 91, the hollow cylinder 90 urges the rectangular loop-like member 91 against the cleaning unit 16. The rectangular loop-like member 91 has two projections 95 and 96 diametrically opposite with respect to an axis of the hollow cylinder 90 parallel to a direction in which the hollow cylinder 90 expands and contracts. The projections 95 and 96 extend downwardly from the upper opening h2 to the lower opening g1. The hollow cylinders 77 and 90 cooperate to form a path of toner that can expand and contract.

Causing the hollow cylinder 90 to contract against its own resiliency so that the rectangular loop-like member 91 moves toward the case 32*a*, allows the projection 95 to push the lever 66. The projection 95 pushes the short lever 66 downward causing the shutter 63 to pivot about a shaft 64 to open the lower opening g1.

The guide 95 and 96 extending in the hollow cylinder 90 prevents the toner T from adhering to or staying at the inner surfaces in the shape of an accordion. This allows the shutter 63 to open and close reliably.

In the present invention, the hollow cylinders 62, 71, 75–77 and 90 have been described as having a rectangular cross section. The cross section may be other shapes, e.g., a circle, a polygon, or the like.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer discharging unit that discharges developer into a developer receiving unit, comprising:

an opening through which the developer is discharged into the developer receiving unit;

an opening-and-closing member movable relative to said opening to open and close said opening;

a first urging member that urges said opening-and-closing member in such a direction as to close said opening-and-closing member; and an engagement portion that receives a drive force from the developer receiving unit when said engagement portion engages the developer receiving unit, the drive force acting on said engagement portion in such a way that said opening-and-closing member causes said opening-and-closing member to open;

wherein said engagement portion causes said opening-and-closing member to open said opening only after the developer discharging unit moves into sealed engagement with the developer receiving unit so that the developer discharging unit communicates with the developer receiving unit through said opening.

2. A developer receiving unit that receives developer from a discharging unit, comprising:

a path through which the developer is received from the developer discharging unit, said path adapted to expand and contract in length;

an opening through which said path communicates with the developer discharging unit when the developer receiving unit moves into sealed engagement with the developer discharging unit;

an urging member that urges said path in such a direction as to expand; and an opening-and-closing member that receives a drive force from the developer discharging unit when the developer discharging unit pushes the developer receiving unit, the drive force acting on said opening-and-closing member in such a way that said opening-and-closing member causes said path to open;

wherein said opening-and-closing member opens said path only after the developer discharging unit moves into sealed engagement with the developer receiving unit so that the developer discharging unit communicates with the developer receiving unit through said path.

3. The developer receiving unit according to claim 2, wherein said path includes a first path member and a second path member that is slidably movable relative to the first path member;

wherein said opening-and-closing member includes an engagement portion;

wherein when the first path member moves relative to the second path member against said urging member, the first path member engages the engagement portion to cause said opening-and-closing member to open said path.

4. The developer receiving unit according to claim 3, wherein the second path member fits over the first path member.

5. The developer receiving unit according to claim 3, wherein the second path member fits in the first path member.

6. The developer receiving unit according to claim 5, wherein the second path member has a guide surface and said opening-and-closing member has a guide surface;

wherein when the guide surface of the second path member pushes the guide surface of said opening-and-closing member, said opening-and-closing member opens said.

7. The developer receiving unit according to claim 6, wherein the first path member has a cleaning member that rubs a surface of said opening-and-closing member.

8. The developer receiving unit according to claim 3, wherein said path includes a first path member and a second path member, the second path member communicating with the first path and being resiliently movable relative to the first path in such a way that said path expands and contracts in length;

wherein said opening-and-closing member includes an engagement portion that receives a drive force from the second path member when the developer discharging unit pushes the developer receiving unit, the drive force acting on said opening-and-closing member in such a way that said opening-and-closing member opens said path.

9. A developer transporting system, comprising:

a first opening formed in a developer discharging unit and through which developer is discharged from the developer discharging unit;

a first opening-and-closing member mounted to the developer discharging unit and movable relative to said first opening to open and close said first opening;

a first urging member mounted to the developer discharging unit and urging said first opening-and-closing member in such a direction as to close said first opening;

a path through which the developer is discharged from the developer discharging unit, said path being able to expand and contract in length;

a second opening that is formed in a developer receiving unit and through which the developer is received into the developer receiving unit;

a second urging member mounted to the developer receiving unit and urging the first path member in such a direction as to expand the path;

a second opening-and-closing member mounted to the developer receiving unit to open and close the path, wherein said second opening-and-closing member closes the path when the path expands, and opens only after the developer discharging unit moves into sealed engagement with the developer receiving unit so that the developer discharging unit communicates with the developer receiving unit through said first opening; and an engagement portion mounted to the developer discharging unit, said engagement portion receiving a drive force from the developer receiving unit when said engagement portion pushes the developer receiving unit, the drive force acting on said engagement portion in such a way that said first opening-and-closing member opens said first path.

10. An image forming apparatus incorporating the developer transporting system according to claim 9.

* * * * *